US008864026B2

(12) United States Patent
Coomer et al.

(10) Patent No.: US 8,864,026 B2
(45) Date of Patent: Oct. 21, 2014

(54) BALLOT IMAGE PROCESSING SYSTEM AND METHOD FOR VOTING MACHINES

(75) Inventors: Eric Coomer, Broomfield, CO (US); Larry Korb, Moraga, CA (US); Brian Glenn Lierman, Exeter, CA (US); Doug Harold Weinel, Evergreen, CO (US)

(73) Assignee: Dominion Voting Systems, Inc., Denver, CO (US)

( * ) Notice: Subject to any disclaimer, the term of this patent is extended or adjusted under 35 U.S.C. 154(b) by 690 days.

(21) Appl. No.: 13/092,606

(22) Filed: Apr. 22, 2011

(65) Prior Publication Data

US 2012/0111940 A1 May 10, 2012

Related U.S. Application Data

(63) Continuation of application No. PCT/US2009/062078, filed on Oct. 26, 2009.

(60) Provisional application No. 61/193,062, filed on Oct. 24, 2008.

(51) Int. Cl.
*G07C 13/00* (2006.01)

(52) U.S. Cl.
CPC ..... *G07C 13/00* (2013.01)
USPC ..... 235/386

(58) Field of Classification Search
USPC ..... 235/386
See application file for complete search history.

(56) References Cited

U.S. PATENT DOCUMENTS

| | | | | |
|---|---|---|---|---|
| 6,854,644 | B1 | 2/2005 | Bolton | |
| 7,077,313 | B2 | 7/2006 | Chung | |
| 2005/0247783 | A1 * | 11/2005 | Poulos et al. | 235/386 |
| 2006/0202031 | A1 | 9/2006 | Chung | |
| 2006/0266829 | A1 * | 11/2006 | Bolton et al. | 235/386 |
| 2007/0170253 | A1 * | 7/2007 | Chung et al. | 235/386 |
| 2008/0308634 | A1 * | 12/2008 | Bolton et al. | 235/386 |

* cited by examiner

*Primary Examiner* — Daniel Hess
(74) *Attorney, Agent, or Firm* — Holland & Hart LLP

(57) ABSTRACT

A ballot processing system and method processes paper ballots, such as by optically scanning or optically reading those ballots. The ballot image processing system corrects for, or is able to differentiate valid voting marks from, ballot printing errors such as skewed printing, incorrect sizing, and speckling. Further, the ballot image processing system, after determining whether each of the voting marks is valid or not, associates audit data with the ballot that corresponds to the decision regarding each voting mark.

27 Claims, 5 Drawing Sheets

BALLOT IMAGE PROCESSING SYSTEM AND METHOD FOR VOTING MACHINES

This application is a continuation of International Application PCT/US09/62078 filed Oct. 26, 2009, which claims the benefit of U.S. Provisional Application No. 61/193,062 filed Oct. 24, 2008. The disclosures of both are incorporated herein by reference in their entirety.

BACKGROUND

In the technology of ballot transaction processing, it is desirable to develop apparatus and methods for processing paper ballots, such as by optically scanning or optically reading those ballots, in a more efficient and reliable manner. The improvements described herein relate to technologies for processing ballots and in particular technologies for optically scanning ballots.

There are numerous voting technologies known that are directed to permitting votes to be cast and recorded efficiently while maintaining the secrecy of the ballot.

It is generally known that ballots can be optically scanned to assist in tabulation and aid in the assessment of voter intent. For example, U.S. Pat. No. 6,854,644 issued to Bolton et al. discloses that a voter's intent can be determined by making a digital image of a mark. The image of the mark is then subjected to a discrimination process that makes a determination as to whether the pixel values in the image correspond to a mark indicating a voter's intent to make a selection. The reference discloses that the determination is reached by comparing the pixel value of a bounded region to a control pixel value set.

Further, it is generally known to print certain identifying information on a ballot when the ballot is printed before an election. For example, U.S. Pat. No. 6,892,944 discloses providing on each ballot a voter registration number that can include a barcode, two-dimensional barcode, a prescribed font, optical character recognition characters, alphanumeric characters, non-alphanumeric characters and symbols. Further, this patent discloses that the voter registration number can include information such as the voter's state, county, precinct etc. in addition to a randomly generated number that is printed on the ballot prior to election.

Of paramount importance in an election process is the efficient verification and auditing of voting results. One of the obstacles associated with the verification is that there is usually a subjective determination made when determining the voter intent. For example, in the case of mechanical based systems that punch out a hole in a ballot, subjective determinations have had to be made in well-publicized cases to determine the voter intent with respect to partially attached chads. These subjective determinations lead to inconsistent results and have a negative impact on public perception of vote integrity. Therefore, it is desirable to provide a ballot processing system that objectively determines voter intent in a consistent and reliable manner and that provides a mechanism for auditing the results on a vote-by-vote basis.

SUMMARY

In view of the above issues, the following improvements are presented.

One improvement relates to a ballot image processing system that corrects for, or is able to differentiate from valid marks, ballot printing errors such as skewed printing, incorrect sizing, and speckling. As such, the ballot image processing system is capable of being tolerant of certain printing errors and removes the need for reprinting of ballots in these circumstances.

In addition to being able to accommodate the above-mentioned printing errors, this improvement also allows the ballot image processing system to correct for, and distinguish between, spurious marks on the ballot caused by such things as dirt on the ballot, ink smears, dirt smears and the bleed through of ink marks from the opposite side of the ballot. By correcting these spurious marks, the ballot image processing system can reduce the potential misreading of ballots and the need for subjective manual interpretation.

This improvement also allows the ballot image processing system to more accurately identify vote target areas and more accurately identify voting intent by accurately identifying actual vote target areas and voting mark types.

Therefore, this improvement allows improved and enhanced review of the ballot image for auditing purposes.

Additionally, this ballot image processing system allows the voter to resolve write-ins themselves at the voting unit. The system is able to detect the presence of write-in candidates on a voter-filled-out ballot and support easier manual resolution by allowing the resolution system to display the write-ins to the user, allowing the user to input (e.g., type) the write-in and then associate the typed write-in information with the ballot for subsequent processing. The improvement allows the write-in resolution system to associate a resolved candidate name with the write-in and thus associate it with the ballot image and ballot image record for tally. The system allows the voter to verify the write-in selection through, for example, a touch screen display, thereby ensuring that the correct vote is cast.

Specifically, one improvement can include a ballot image processing system having an optical ballot scanner that scans ballots to produce an image of each ballot and an image processing portion that processes the image of the ballot with digital image processing techniques by using predetermined marks on the ballot to correct for ballot skew and image size variations. The image processing portion can be configured to analyze voting target areas on the ballot and make a target decision regarding each mark by identifying specific allowed voting marks on the ballot to assess voter intentions. Further, a printer can be provided to print audit data onto the ballot after the ballot has been cast by the voter. The audit data can include information regarding each target decision made by the image processing portion.

The ballot image processing system can correct for at least one of printing defects and variations, misfeeds and scanning errors.

The ballot image processing system also can identify voting target area identification shapes and can select marks from the group consisting of square boxes, rectangular boxes, circles, ellipses, and two arrow ends to be joined.

The allowed voting marks can be at least one of horizontal lines, diagonal lines, vertical lines, arrows, crosses, ticks, and filled target areas.

The audit data can include at least one of mark categorization, voting mark type and threshold measurements determined by the image processing portion.

The ballot image processing system can optionally include a vote tallying system to tally voting results that uses target decision data generated by the image processing portion to supplement the ballot image during review. The supplementing of the ballot image can include at least one of color coded highlights indicating target mark categorization and strength of the target decision data.

The image processing portion can utilize. DIP algorithms to enhance the ballot images to correct for at least one of speckling, dirt, smears and bleed through.

The image processing portion can also use digital image processing techniques to analyze predetermined vote target areas for detection of write-in intent. If write-in intent is detected, the image processing portion can isolate the ballot image of the predetermined vote target area and associate a sub-image of the scanned write-in with the ballot image record.

The ballot image processing system can further include a display portion and an input portion. If write-in intent is detected, the display portion can provide a user (the voter) with an opportunity to enter the intended write-in via the input portion. Further, the entered write-in input data can be added to the ballot image record and/or the entered write-in input data can printed on the ballot by the printer in at least one of a human readable form and a machine readable form.

The ballot image processing system can further include a write-in resolution system that allows the ballot image records and an associated write-in sub-image of the write-in to be viewed by a user through the display portion and verified by the user by typing in the associated name or selecting a registered candidate through the input portion.

The ballot image records, and the associated write-in sub-image verified by the user, can be associated with the write-in sub-image and thus the ballot image record.

The image processing portion can analyze predetermined target areas to detect at least one of poll worker initials or signatures, polling place IDs and precinct IDs.

The optical ballot scanner can analyze predetermined target areas to detect the presence of, and decode 1D and 2D bar codes.

A further improvement can include a method of processing a ballot. The method can include: optically scanning a ballot to create an image of the ballot; detecting, using digital image processing techniques, whether defects due to printing and/or scanning exist in the image of the ballot; correcting any defects on the image of the ballot; identifying target areas on the image of the ballot; categorizing the target areas; identifying whether a voting mark is present in the target areas; determining whether each particular voting mark is valid or not; and associating decision information for each voting mark on the ballot.

The defects can include at least one of printing defects and variations, misfeeds and scanning errors.

The target areas are selected from the group including square boxes, rectangular boxes, circles, ellipses, and two arrow ends to be joined.

Valid voting marks can be at least one of horizontal lines, diagonal lines, vertical lines, arrows, crosses, ticks, and filled target areas.

The decision information can include at least one of mark categorization, voting mark type and threshold measurements.

The decision information is printed on the ballot in at least machine readable form and/or can be saved as a file associated with an electronic record of the image of the ballot.

BRIEF DESCRIPTION OF THE DRAWINGS

The foregoing and further objects, features and advantages of the apparatus and methods described herein will become apparent from the following descriptions of exemplary embodiments with reference to the accompanying drawings, in which like numerals are used to represent like elements and wherein.

DETAILED DESCRIPTION

Figure 1:
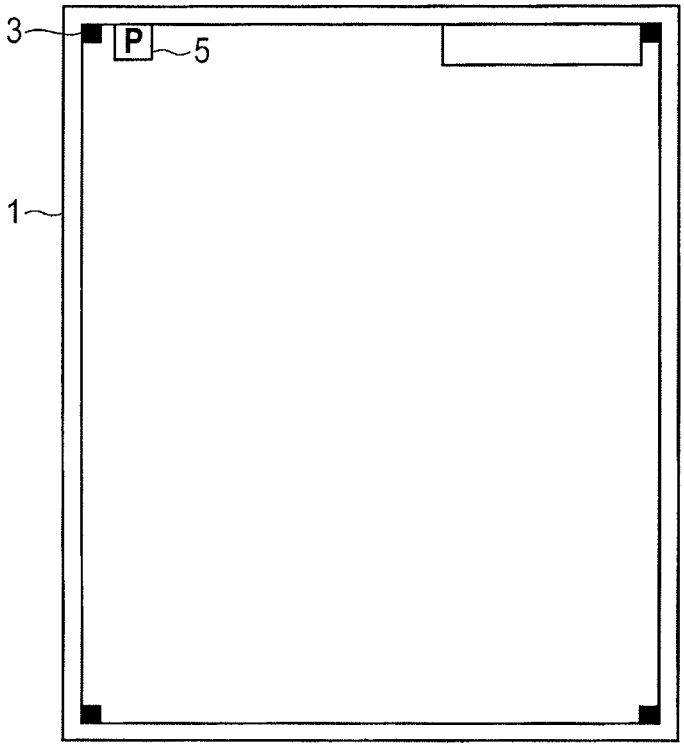
FIG. 1 is a diagram illustrating an example of a front of a blank ballot.
Figure 2:
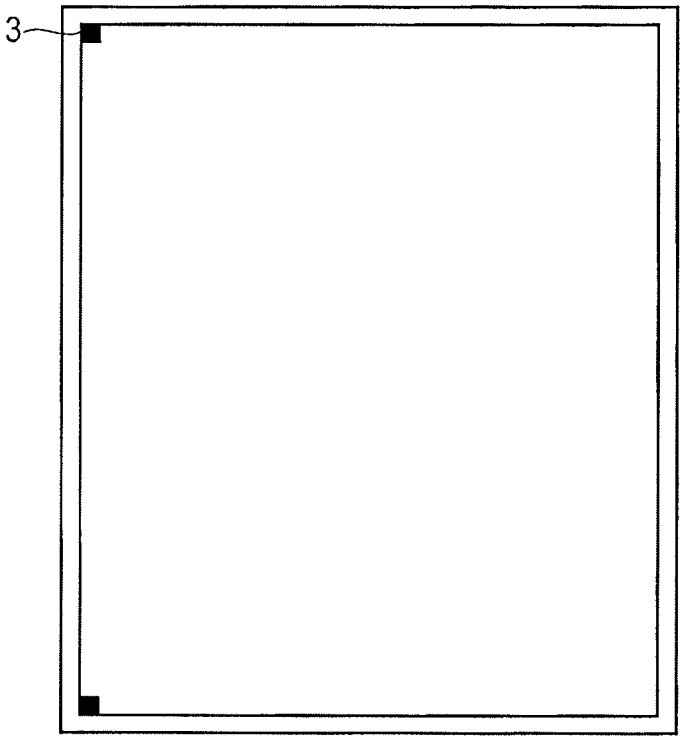
FIG. 2 is a diagram illustrating an example of a back of a blank ballot.

FIGS. 1 and 2 illustrate an example of a front and a back of a ballot 1 before any voter selection information is printed thereon. The ballot 1 can be, for example, 4.25 inches or 8.5 inches wide and from 11 inches to 22 inches in length. In one embodiment illustrated in FIG. 1, the ballot 1 has ballot registration marks 3 which are solid black 0.25 inch squares located just inside of a 0.25 inch unprinted area, bounding all sides of the ballot 1. Where the ballot 1 is longer than 11 inches, additional registration marks are desirable and can be provided.

Figure 3:
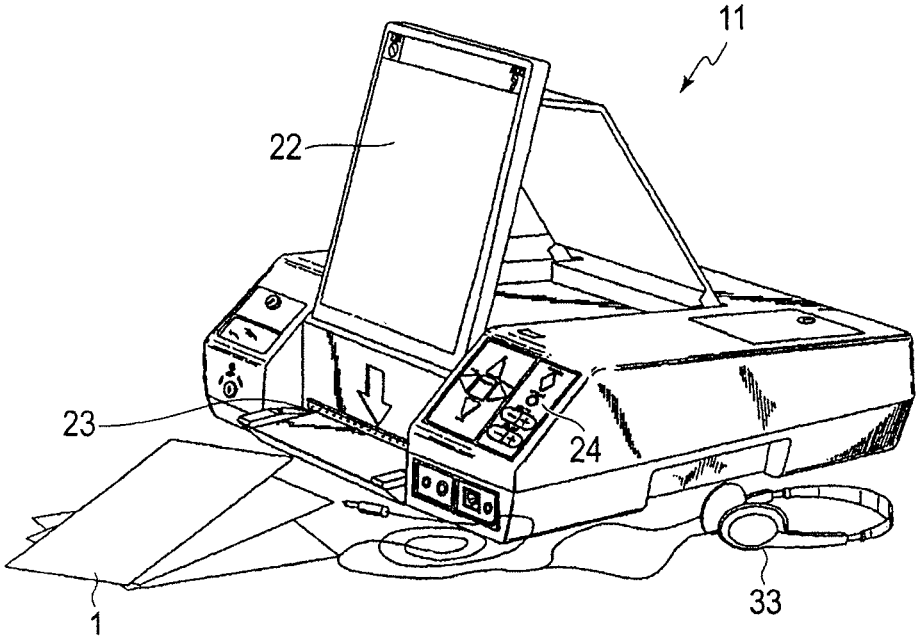
FIG. 3 is a diagram illustrating an example of a voting unit.
Figure 4:
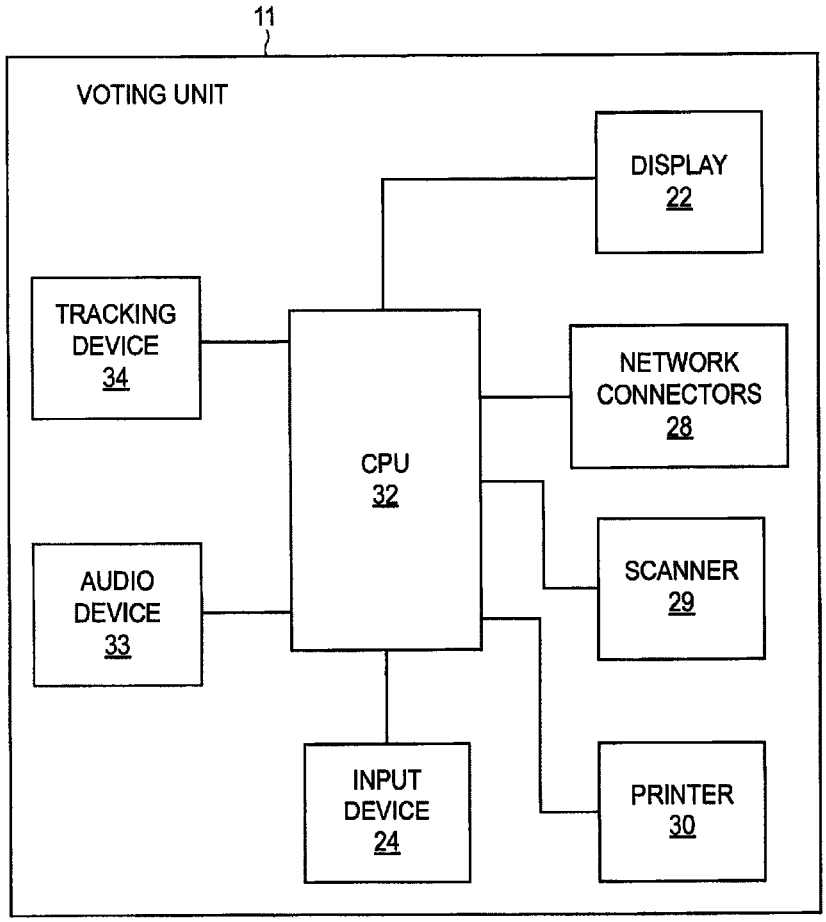
FIG. 4 is a diagram illustrating some of the components of a voting unit.

FIG. 3 illustrates an example of a voting unit 11 that can be an optical ballot scan device. As seen from FIG. 3, voting unit 11 can include an input slot 23 into which a ballot 1 to be scanned is fed, a ballot feed tray 38, a display 22, an audio device 33, and a user-manipulatable input device 24. FIG. 4 illustrates some of the components that can be included in each voting unit 11. The voting unit 11 can include a CPU 32 that controls operation of the voting unit 11 including the functions described herein, a tracking device 34, an audio device 33, an input device 24, an optical scanner 29, a printer 30, network connectors 28 and a visual display unit 22. Voting unit 11 is not limited to these specific components as any number of other components known to one of ordinary skill in the art for inclusion on voting units could be incorporated therein.

Additionally, the voting unit 11 via CPU 32, which can function as an image processing portion, is able to process a digital image of the ballot and is able to use ballot registration marks 3 (see FIG. 1) on the ballot 1 to correct for ballot skew resulting from effects such as, but not limited to, printing defects and variations, misfeeds and scanning errors. There are numerous known third party commercially available Digital Image Processing (DIP) packages that can be employed that are capable of achieving these effects (such as rotation, skew, scaling, mirroring, pinching). Further, the voting unit 11 is able to process the digital image and to use the ballot registration marks 3 on the ballot 1 to correct for image size variations, caused by effects such as, but not limited to, printing defects and variations.

Figure 5:
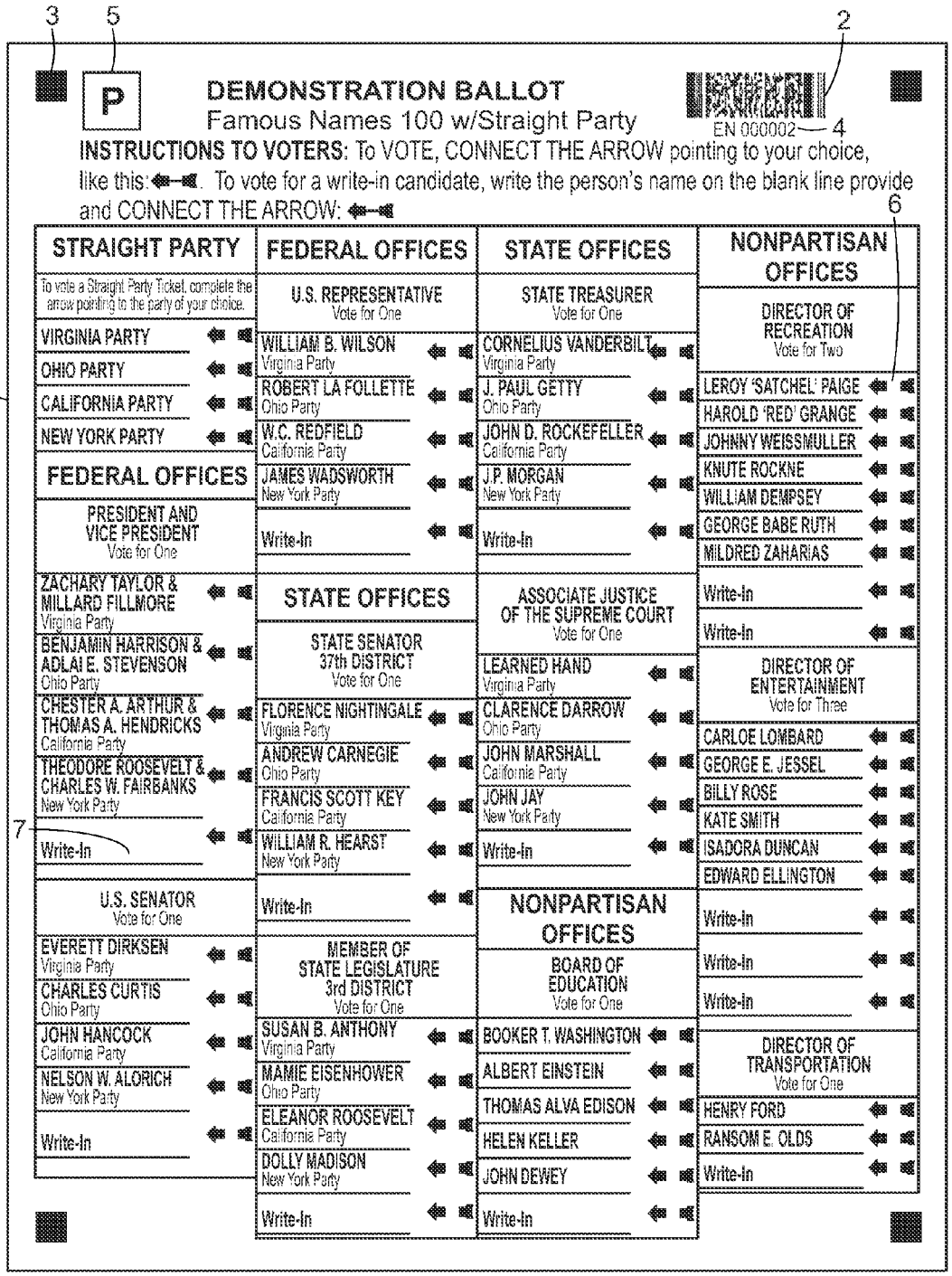
FIG. 5 is a diagram illustrating an example of a front of a ballot with voter choice selection information printed thereon.
Figure 6:
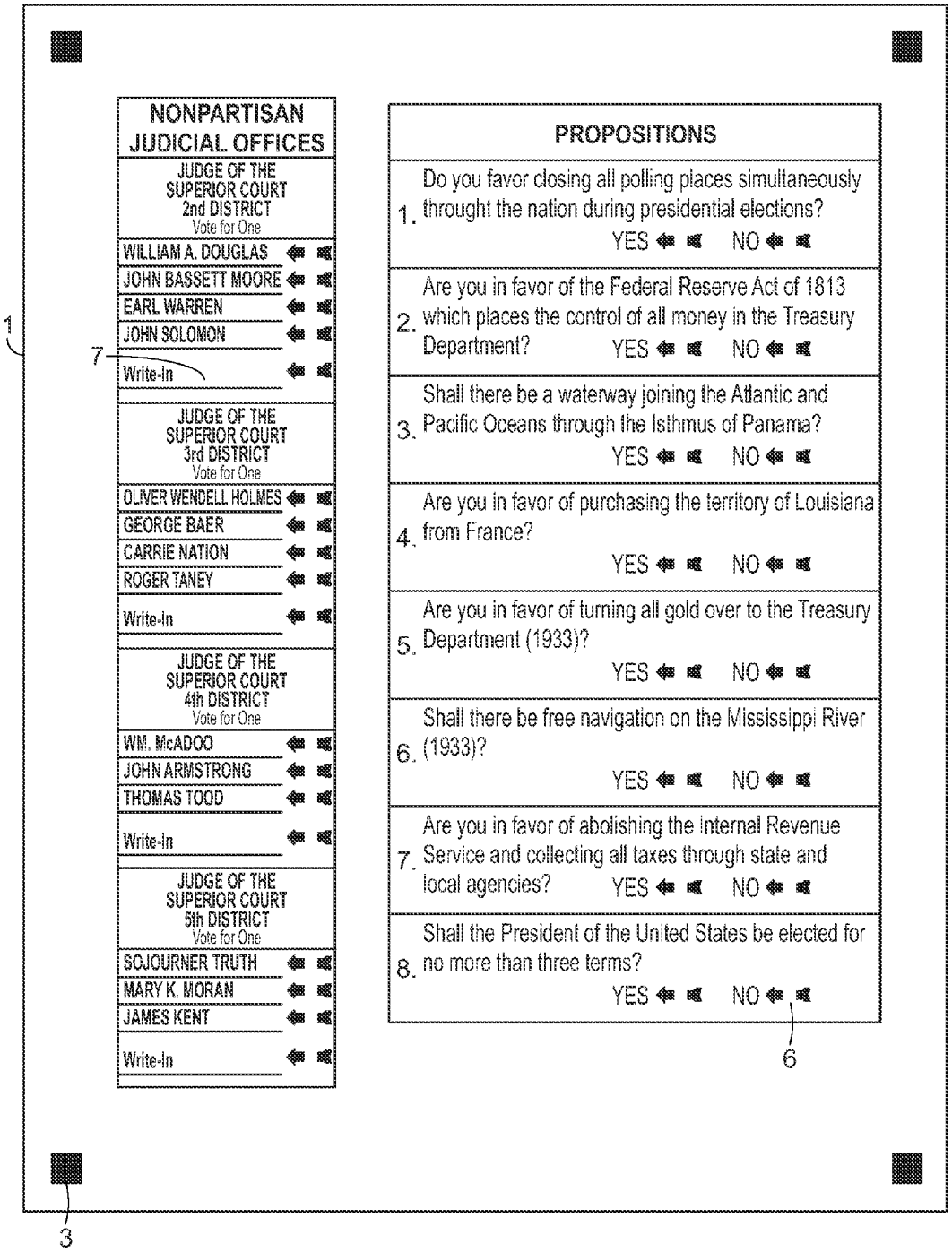
FIG. 6 is a diagram illustrating an example of a back of a ballot with voter choice selection information printed thereon.

FIGS. 5 and 6 illustrate the front and back of a ballot 1 that has voter and candidate information printed thereon (the ballot has not been filled in by the voter). Voter target areas are illustrated, for example, in FIGS. 5 and 6 as partial arrow 6 and candidate write-in area 7.

The image processing portion (CPU 32) is capable of narrowing voting target areas by analyzing the expected location and identifying target area identification shapes and marks for greater location accuracy. For example, image recognition software can be employed to locate the voting target artifacts in a given region of a ballot. The region is a bounding area of the target location and the image recognition system can pinpoint the boundaries of the target thereby increasing the accuracy of the optical mark recognition and interpretation engine. These target areas can include shapes and marks that may include but not be limited to square and rectangular boxes, circles, ellipses and two lines (to be joined) known as "Arrow ends". For example, FIG. 5 illustrates an embodiment where the voting marks consist of separated ends of an arrow 6 that the voter can connect to cast a vote for a particular candidate.

Further, the image processing portion can analyze voting target areas and identify specific allowed voting marks to assess voter intentions. Existing systems can calculate the percentage of pixels within the bounded area, which are black or gray above a set threshold. The system can then define a mark as any area that has at least a minimum percentage of pixels as black. See, for example, U.S. Pat. No. 6,854,644, the disclosure of which is incorporated by reference herein in its entirety. Additional image recognition techniques could be applied to determine if there is a continuous line of dark pixels from one end of the target to the other. Such marks may include, but not be limited to: horizontal lines; diagonal lines; vertical lines; arrows; crosses; ticks; and filled target areas.

The image processing portion is capable of associating audit data with each target decision that the image processing portion makes. This data may include but not be limited to: mark categorization (voting mark, non voting mark); voting mark type; and threshold measurements. etc. For example, a given target area that was analyzed by the voting system may consist of a rectangular bounding box. The coordinates relative to the upper left registration mark can be included in the target analysis record. This provides the pin-point location the recognition system interrogated to determine whether a mark was detected. If using a percentage of dark pixels, this percentage value detected also can be stored with the analysis record. Finally, if the recognition system detected that the mark within the bounded area was a contiguous line, an attribute for 'line' can be added to the record. The audit data may be stored in a file associated with the scanned image of the ballot, which may be displayed on the display 22 if supplied with the voting unit 11. The file of audit data can be stored in the ROM of a computer, a hard drive, a removable storage device or any other suitable storage medium.

The improvement also includes a system to tally results that uses the target decision data generated by the image processing portion in the voting unit 11 to enhance the ballot image during review. This may include, but is not limited to, color coded highlights indicating the target mark categorization and the strength of the decision. Using the coordinate data of the analysis record, the bounding box defining the optical mark target area can be displayed over the digital image. If the system determined that a valid voting mark was registered, the bounding box can be displayed with a green border. If no mark was detected, the bounding box can be displayed with a red border.

The image processing portion is also capable of running DIP algorithms to enhance images to correct for such effects as, but not limited to: speckling; dirt; smears; and 'bleed through.' There are commercially available third party image processing packages that are capable of such corrections.

In addition to detecting target areas on the ballot 1, the image processing portion is capable of analyzing special vote target areas for detection of 'write-in' intent (see write-in area 7 of FIGS. 5 and 6). If a 'write-in' intent is detected, the image processing portion of CPU 32 will isolate the part of the ballot image containing the write-in selection and associate that sub-image with that ballot image record, the scanned image and the associated contest. Additionally, if a 'write-in' intent is detected, the image processing portion will provide the voter with an opportunity to input the intended write-in (e.g., by typing the name) or select a registered write-in candidate from a list via user-manipulatable input device 24 (such as a touch screen, keypad, or audio control box) and thus resolve the write-in themselves at the time of voting. Further, if a 'write-in' intent is entered by the voter via the input device 24, which is then associated or recorded with the write-in image and as a result also is associated or recorded with the ballot image, the ballot image record and the contest, the voter intent will be clear for auditing purposes.

The input data entered by the voter via the input device 24 can then be printed on the ballot in at least one of a human readable form and a machine readable barcode 2. An example of a machine readable barcode 2 is illustrated in FIG. 5. The machine readable barcode 2 in this embodiment is located on the upper right corner of the front side of the ballot 1 and is contained within a 0.6 inch×2.75 inch area. FIG. 5 shows a human readable version 4 of the machine readable barcode 2 printed below the machine readable barcode 2.

In addition, the image processing portion is capable of analyzing special target areas to detect such artifacts as, but not limited to: poll worker initials or signatures; polling place ID's; and precinct ID's. Further, the image processing portion is additionally capable of analyzing special target areas to detect the presence of, and decode various 1D and 2D bar codes.

When the optical ballot scanner 29 scans a ballot 1, the optical ballot scanner 29 scans the entire image of the ballot 1 and processes the scanned image using known Digital Image Processing techniques. These processing techniques apply algorithms to the scanned image to detect features, categorize the detected features and make decisions based on the detected features.

Before the image processing portion identifies any voting marks on the ballot, the image processing portion uses Digital Image Processing algorithms to correct for alignment deficiencies in the ballot image. For example, the image processing portion detects features on the ballot 1 and is able to determine if the ballot image is skewed, misaligned, or the incorrect size. The image processing portion can then correct the ballot image so that it is straight, centered and the correct size.

Additionally, before the image processing portion identifies any voting marks on the ballot 1, the image processing portion uses Digital Image Processing algorithms to clean up the ballot image: For example, the image processing portion can remove the effects of speckling, dirt, smears and bleed through. This ensures that such defects (whether through printing problems, poor handling or other reasons) will not adversely effect the detection of valid voting marks or lead to the detection of invalid voting marks.

Next, the image processing portion identifies target areas on the ballot 1 and applies Digital Image Processing algorithms to look for, detect and categorize expected voting target markers.

Additionally, the image processing portion is capable of detecting different shaped markers, such as the bars that form "arrow" target markers (see for example FIG. 6), square target markers, rectangular target markers, circular target markers and oval target markers. When the image processing portion has detected the correct type of target marker for the election in the general target areas, the image processing portion calculates the center and size of those target markers and uses that information to adjust the center and size of the target areas to be examined for voting marks.

The image processing portion also can examine special target areas and apply Digital Image Processing algorithms to identify the presence of such artifacts such as Poll worker initials or signatures; Polling Place ID's; Precinct ID's.

The image processing portion examines the adjusted target areas and applies Digital Image Processing algorithms to identify whether there is a voting mark present. If certain predetermined criteria (such as threshold requirements) are met, the image processing portion categorizes the voting mark as valid. Further, the image processing portion uses Digital Image Processing (DIP) algorithms to identify the types of expected voting marks. For example, the image processing portion is able to detect, identify and categorize horizontal lines, diagonal lines, vertical lines, arrows, crosses, ticks, and filled target areas. Thus, the image processing portion can confirm that a target area does actually contain an authorized voting mark and not a spurious mark. Several commercially available third party pattern recognition packages can be employed to characterize these voting marks.

When the image processing portion has detected a mark in voting target area, the image processing portion categorizes the mark and associates decision information to the mark. If the mark has been categorized as a valid voting mark, the image processing portion will associate information such as the voting mark type and decision threshold and statistical information used to make the determination. If a mark is detected but is not categorized as a valid voting mark, the image processing portion will associate information such as the mark type, why the mark is not a valid voting mark and the decision threshold and statistical information used to make the determination. The image processing portion also is able to create an associated overlay image that provides a visual representation (such as color code highlights and shapes) of the categorization and decision-making data associated with marks in the voting areas. These images and the associated data can then be used to assist in audit processes.

Further, if the image processing portion detects a valid voting mark in a write-in area, the image processing portion will isolate the area allocated to write in information and create a sub-image of that area which the image processing portion will associate with the ballot image and that particular contest on the ballot image. In the situation where a visual interface and a user input device are provided, the image processing portion will allow the user to verify the presence of the write in and to either type in the intended write-in choice or choose it from a selection of valid registered write-in choices. If this is done, that write-in information will be associated with the ballot image, and will be added to the rest of the overlay data so it is able to be overlaid on the image. This feature allows the voter to resolve the write in at the time of voting. If the user resolves a write-in and the voting unit 11 via printer 30 has the capability of printing a bar code 2 and words on the ballot 1, the printer 30 will print the resolved write in information on the ballot 1 and include the write-in information in a printed barcode 2.

The foregoing description is considered as illustrative only of the principles of the improvements discussed above. The inventions described herein are not limited to specific examples provided herein.

What is claimed is:

1. A ballot image processing system comprising:

an optical ballot scanner that scans ballots to produce an image of each ballot;

an image processing portion that processes the image of the ballot with digital image processing techniques by using marks on the ballot to correct for ballot skew and image size variations, the image processing portion being configured to analyze voting target areas on the ballot and make a target decision regarding each mark by identifying specific allowed voting marks on the ballot to assess voter intentions;

a printer to print audit data onto the ballot after the ballot has been cast, the audit data including information regarding each target decision made by the image processing portion; and a vote tallying system to tally voting results that uses target decision data generated by the image processing portion to supplement the ballot image during review, the supplementing of the ballot image includes at least one color coded highlight indicating target mark categorization and strength of the target decision data.

2. The ballot image processing system of claim 1, wherein the image processing portion corrects for at least one of printing defects and variations, misfeeds and scanning errors.

3. The ballot image processing system of claim 1, wherein voting target area identification shapes and marks are selected from the group consisting of square boxes, rectangular boxes, circles, ellipses, and two arrow ends to be joined.

4. The ballot image processing system of claim 1, wherein the allowed voting marks are at least one of horizontal lines, diagonal lines, vertical lines, arrows, crosses, ticks, and filled target areas.

5. The ballot image processing system of claim 1, wherein the audit data includes at least one of mark categorization, voting mark type and threshold measurements determined by the image processing portion.

6. The ballot image processing system of claim 1, wherein the image processing portion utilizes DIP algorithms to enhance the ballot images to correct for at least one of speckling, dirt, smears and bleed through.

7. The ballot image processing system of claim 1, wherein the image processing portion uses digital image processing techniques to analyze predetermined vote target areas for detection of write-in intent, if write-in intent is detected the image processing portion isolates the ballot image of the predetermined vote target area and associates a sub-image of the scanned write-in with the ballot image record.

8. The ballot image processing system of claim 7, further comprising a display portion and an input portion, wherein if write-in intent is detected, the display portion provides a user with an opportunity to enter the intended write-in via the input portion.

9. The ballot image processing system of claim 8, wherein the entered write-in input data is added to the ballot image record by the printer.

10. The ballot image processing system of claim 9, wherein the entered write-in input data is printed on the ballot by the printer in at least one of a human readable form and a machine readable form.

11. The ballot image processing system of claim 1, further comprising: a display portion; an input portion; and a write-in resolution system that allows the ballot image records and an associated write-in sub-image of the write-in to be viewed by a user through the display portion and verified by the user by typing in the associated name or selecting a registered candidate through the input portion.

12. The ballot image processing system of claim 11, wherein the ballot image records and associated write-in sub-image verified by the user are associated with the write-in sub-image and thus the ballot image record.

13. The ballot image processing system of claim 1, wherein the image processing portion analyzes predetermined target areas to detect at least one of poll worker initials or signatures, polling place IDs and precinct IDs.

14. The ballot image processing system of claim 1, wherein the optical ballot scanner analyzes predetermined target areas to detect the presence of, and decode ID and 2D bar codes.

15. A method of processing a ballot comprising:

optically scanning a ballot to create an image of the ballot;

detecting, using digital image processing techniques, whether defects due to printing and/or scanning exist in the image of the ballot;

correcting any defects on the image of the ballot;

identifying target areas on the image of the ballot;

categorizing the target areas;

identifying whether a voting mark is present in the target areas;

determining whether each particular voting mark is valid or not;

associating decision information for each voting mark on the ballot; and tallying voting results based on the decision information to supplement the image of the ballot, wherein the supplementing of the image includes at least one color coded highlight indicating target mark categorization and strength of the decision information.

16. The method according to claim 15, wherein the defects include at least one of, printing defects and variations, misfeeds and scanning errors.

17. The method according to claim 15, wherein the target areas are selected from the group consisting of square boxes, rectangular boxes, circles, ellipses, and two arrow ends to be joined.

18. The method according to claim 15, wherein valid voting marks are at least one of horizontal lines, diagonal lines, vertical lines, arrows, crosses, ticks, and filled target areas.

19. The method according to claim 15, wherein the decision information includes at least one of mark categorization, voting mark type and threshold measurements.

20. The method according to claim 15, wherein the decision information is printed on the ballot in at least machine readable form.

21. The method according to claim 15, wherein the decision information is saved as a file associated with an electronic record of the image of the ballot.

22. A ballot image processing system comprising:

an optical ballot scanner that scans a ballot to produce an image of a ballot;

an image processing portion that processes the image of the ballot with digital image processing techniques by using marks on the ballot to correct for ballot skew and image size variations, the image processing portion being configured to analyze voting target areas on the ballot and make a target decision regarding each mark by identifying specific allowed voting marks on the ballot to assess voter intentions;

a printer to print audit data onto the ballot after the ballot has been cast, the audit data including information regarding each target decision made by the image processing portion; and a write-in resolution system that allows the ballot image records and an associated write-in sub-image of the write-in to be viewed by a user through a display portion and verified by the user by typing in the associated name or selecting a registered candidate through an input portion.

23. The ballot image processing system of claim 22, wherein the ballot image records and associated write-in sub-image verified by the user are associated with the write-in sub-image and thus the ballot image record.

24. The ballot image processing system of claim 22, wherein the image processing portion corrects for at least one of printing defects and variations, misfeeds and scanning errors.

25. The ballot image processing system of claim 22, wherein the image processing portion uses digital image processing techniques to analyze predetermined vote target areas for detection of write-in intent, if write-in intent is detected the image processing portion isolates the ballot image of the predetermined vote target area and associates a sub-image of the scanned write-in with the ballot image record.

26. A method of processing a ballot comprising:

scanning the ballot to produce an image of the ballot;

processing the image of the ballot to correct at least one defect on the image of the ballot, wherein the processing comprises analyzing a target area on the ballot to make a determination regarding a mark on the ballot and assessing voter intent;

printing audit data onto the ballot, the audit data including information regarding the determination; and tallying voting results based on the determination of the voter intent and the mark on the ballot to supplement the image of the ballot, the supplementing of the image of the ballot includes at least one color coded highlights indicating target mark categorization.

27. The method according to claim 26, wherein the at least one defect include at least one of printing defects and variations, misfeeds and scanning errors.

* * * * *